US011351547B2

(12) United States Patent
Geng et al.

(10) Patent No.: US 11,351,547 B2
(45) Date of Patent: Jun. 7, 2022

(54) MICRO-FLUIDIC CHIP, FABRICATING METHOD AND DRIVING METHOD THEREOF

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Yue Geng, Beijing (CN); Peizhi Cai, Beijing (CN); Fengchun Pang, Beijing (CN); Le Gu, Beijing (CN); Chuncheng Che, Beijing (CN); Nan Zhao, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 208 days.

(21) Appl. No.: 16/610,318

(22) PCT Filed: Mar. 26, 2019

(86) PCT No.: PCT/CN2019/079700
§ 371 (c)(1),
(2) Date: Nov. 1, 2019

(87) PCT Pub. No.: WO2019/184913
PCT Pub. Date: Oct. 3, 2019

(65) Prior Publication Data

US 2020/0078791 A1 Mar. 12, 2020

(30) Foreign Application Priority Data

Mar. 28, 2018 (CN) ..... 201810264326.3

(51) Int. Cl.
*B01L 3/00* (2006.01)

(52) U.S. Cl.
CPC ... *B01L 3/502792* (2013.01); *B01L 3/502715* (2013.01); *B01L 2200/026* (2013.01); *B01L 2300/0819* (2013.01)

(58) Field of Classification Search
CPC ..... B01L 3/502792; B01L 3/502715; B01L 3/5027; B01L 3/502; B01L 3/50; B01L 2200/026; B01L 2300/0819
(Continued)

(56) References Cited

U.S. PATENT DOCUMENTS

2019/0105655 A1* 4/2019 Dong ..... B01L 3/50273

FOREIGN PATENT DOCUMENTS

CN 106861779 A 6/2017
CN 107497509 A 12/2017
(Continued)

*Primary Examiner* — Christine T Mui
(74) *Attorney, Agent, or Firm* — Nath, Goldberg & Meyer; Joshua B. Goldberg

(57) ABSTRACT

Micro-fluidic chip comprises substrate and plurality of driving circuits on substrate, each of plurality of driving circuits comprising: driving electrode comprising first electrode plate and second electrode plate made of different materials on substrate, first electrode plate being electrically coupled to second electrode plate; and detecting sub-circuit comprising first signal terminal electrically coupled to first electrode plate and second signal terminal electrically coupled to second electrode plate, wherein micro-fluidic chip further comprises: voltage supply sub-circuit configured to supply driving voltage to first signal terminal to control droplet to move toward driving circuit during droplet driving stage, and configured to supply constant voltage to first signal terminal, during temperature detecting stage, and wherein detecting sub-circuit is configured to measure voltage difference between first signal terminal and second signal
(Continued)

terminal, and obtain temperature of droplet on second electrode plate according to voltage difference, during temperature detecting stage.

16 Claims, 4 Drawing Sheets

(58) Field of Classification Search
USPC ..... 422/502, 500, 50
See application file for complete search history.

(56) References Cited

FOREIGN PATENT DOCUMENTS

| | | | |
|---|---|---|---|
| CN | 208115783 | U | 11/2018 |
| EP | 1783452 | A1 | 5/2007 |

* cited by examiner

MICRO-FLUIDIC CHIP, FABRICATING METHOD AND DRIVING METHOD THEREOF

CROSS-REFERENCE TO RELATED APPLICATION

This is a National Phase Application filed under 35 U.S.C. 371 as a national stage of PCT/CN2019/079700, filed on Mar. 26, 2019, an application claiming the benefit of priority to Chinese Patent Application No. 201810264326.3 filed on Mar. 28, 2018 filed in the National Intellectual Property Administration, PRC, the contents of which are incorporated herein in their entirety by reference.

TECHNICAL FIELD

The present disclosure belongs to the field of digital micro-fluidic technology, and particularly relates to a micro-fluidic chip, a fabricating method thereof and a driving method thereof.

BACKGROUND

Droplets can be driven to move accurately by using the digital micro-fluidic technology, thereby realizing operations such as fusion and separation of the droplets, and completing various biochemical reactions. Compared with the conventional micro-fluidic technology, the digital micro-fluidic technology can be used for accurately operating the droplets in unit of one droplet, the target reaction can be completed with less amount of reagent, and therefore more accurately control of the reaction rate and the reaction progress can be achieved.

SUMMARY

The present disclosure provides a micro-fluidic chip, including: a substrate and a plurality of driving circuits on the substrate, each of the plurality of driving circuits including:

a driving electrode including a first electrode plate and a second electrode plate made of different materials on the substrate, the first electrode plate being electrically coupled to the second electrode plate; and a detecting sub-circuit including a first signal terminal electrically coupled to the first electrode plate and a second signal terminal electrically coupled to the second electrode plate.

The micro-fluidic chip further includes: a voltage supply sub-circuit configured to supply a driving voltage to the first signal terminal to control a droplet to move toward the driving circuit during a droplet driving stage, and configured to supply a constant voltage to the first signal terminal, during a temperature detecting stage.

The detecting sub-circuit is configured to measure a voltage difference between the first signal terminal and the second signal terminal, and obtain a temperature of a droplet on the second electrode plate according to the voltage difference, during the temperature detecting stage.

According to an embodiment of the present disclosure, the voltage supply sub-circuit is configured to apply a ground voltage to the first signal terminal during the temperature detecting stage.

According to an embodiment of the present disclosure, the detecting sub-circuit further includes: a first resistor and a multistage amplifier circuit having amplifier stages.

A first end of the first resistor is coupled to the second electrode plate, and a second end of the first resistor is coupled to a non-inverting input terminal of a first amplifier stage of the multistage amplifier circuit, an output terminal of a last amplifier stage of the multistage amplifier circuit is coupled to the second signal terminal, and inverting input terminals of the amplifier stages of the multistage amplifier circuit are coupled to the first signal terminal.

According to an embodiment of the present disclosure, each of the amplifier stages of the multistage amplifier circuit includes a second resistor, a third resistor, and a switch transistor.

A first end of the second resistor is coupled to a control electrode of the switch transistor and is used as a non-inverting input terminal of the amplifier stage, and a second end of the second resistor and a first end of the third resistor are coupled to a power supply, a second end of the third resistor is coupled to a first electrode of the switch transistor and is used as an output terminal of the amplifier stage, and a second electrode of the switch transistor is used as an inverting input terminal of the amplifier stage.

According to an embodiment of the present disclosure, the first resistor, the second resistor, and the third resistor each include a resistance wire, and the resistance wire and the second electrode plate are arranged on a same layer and made of a same material.

According to an embodiment of the disclosure, the first electrode plate and the second electrode plate of the driving electrode are sequentially arranged along a direction away from the substrate, an orthographic projection of the first electrode plate at least partially overlaps with that of the second electrode plate on the substrate, and the first electrode plate and the second electrode plate are electrically coupled to each other through a first via hole penetrating through an interlayer insulating layer between the first electrode plate and the second electrode plate.

According to the embodiment of the disclosure, a first insulating layer is further disposed on a side of the driving electrode away from the substrate, and a second via hole is formed in the first insulating layer and exposes at least a part of the second electrode plate.

According to an embodiment of the disclosure, a second insulating layer is further disposed on a side of the first insulating layer away from the substrate, the second via hole penetrates through the second insulating layer to expose at least a part of the second electrode plate, and a material of the second insulating layer includes a hydrophobic material.

According to an embodiment of the present disclosure, the second insulating layer includes teflon.

According to an embodiment of the present disclosure, the first insulating layer includes a hydrophilic material.

According to an embodiment of the present disclosure, a material of the first electrode plate includes molybdenum, and a material of the second electrode plate includes indium tin oxide; or the material of the first electrode plate includes indium tin oxide, and the material of the second electrode plate includes molybdenum.

The present disclosure provides a fabricating method of a micro-fluidic chip, including:

forming a driving electrode of each driving circuit on a substrate, wherein forming the driving electrode includes: respectively forming a first electrode plate and a second electrode plate of the driving electrode on the substrate;

forming a detecting sub-circuit of each driving circuit on the substrate, wherein forming the detecting sub-circuit includes forming a first signal terminal and a second signal terminal, the first signal terminal being electrically coupled to the first electrode plate, and the second signal terminal being electrically coupled to the second electrode plate;

arranging a voltage supply sub-circuit configured to apply corresponding voltages to the first signal terminal during a droplet driving stage and a temperature detecting stage, respectively.

According to an embodiment of the present disclosure, the detecting sub-circuit further includes: a first resistor and a multistage amplifier circuit having amplifier stages, wherein each amplifier stage of the multistage amplifier circuit includes a second resistor, a third resistor and a switch transistor, and the first resistor, the second resistor and the third resistor each include a resistance wire; and the resistance wire and the second electrode plate are formed by one patterning process.

According to an embodiment of the present disclosure, respectively forming the first electrode plate and the second electrode plate of the driving electrode on the substrate includes:

forming the first electrode plate on the substrate;

forming an interlayer insulating layer, and etching the interlayer insulating layer to form a first via hole;

forming the second electrode plate, the first electrode plate and the second electrode plate being electrically coupled to each other through the first via hole, and an orthographic projection of the first electrode plate on the substrate at least partially overlaps with an orthographic projection of the second electrode plate on the substrate.

According to an embodiment of the present disclosure, the method further includes, after forming the second electrode plate, forming a first insulating layer, and etching the first insulating layer to form a via hole;

forming a second insulating layer, and removing a material of the second insulating layer at a position corresponding to the via hole in the first insulating layer to form a second via hole penetrating through the first insulating layer and the second insulating layer; wherein at least a part of the second electrode plate is exposed at the second via hole, and a material of the second insulating layer includes a hydrophobic material.

According to an embodiment of the present disclosure, the method further includes, after forming the second electrode plate, forming a first insulating layer;

forming a second insulating layer;

etching the first insulating layer and the second insulating layer to form a second via hole penetrating through the first insulating layer and the second insulating layer; wherein at least a part of the second electrode plate is exposed at the second via hole, a material of the second insulating layer includes a hydrophobic material, and a material of the first insulating layer includes a hydrophilic material.

The present disclosure provides a driving method of a micro-fluidic chip including:

during a droplet driving stage, applying, by a voltage supply sub-circuit, a driving voltage to the first signal terminal to control a movement of a droplet;

during a temperature detecting stage: applying a low power supply voltage to the first signal terminal by the voltage supply sub-circuit, and measuring a voltage difference between the first signal terminal and the second signal terminal and obtaining a temperature of the droplet on the second electrode plate according to the voltage difference, by a detecting sub-circuit.

DETAILED DESCRIPTION

In order to enable a person skilled in the art to better understand the technical solutions of the present disclosure, the present disclosure will be described in further detail below with reference to the accompanying drawings and specific embodiments.

The digital micro-fluidic chip generally only has the function of operating droplets. For a process in which detecting reaction temperature is required, an existing temperature sensor is directly combined with the digital micro-fluidic chip in the existing operation manner, resulting in a high manufacturing cost of the digital micro-fluidic chip and an increase in overall volume. In addition, the temperature measurement is performed only from the outside of the chip, resulting in a low accuracy of the temperature measurement. Furthermore, the electrode of the digital micro-fluidic chip has a small size, so it is difficult to fabricate a temperature sensor array with respective temperature sensors corresponding in one-to-one correspondence to the electrodes, which is not conducive to the application and popularization of the digital micro-fluidic chip in the field of biological detecting.

Therefore, the present disclose provides a micro-fluidic chip with both a droplet driving function and a droplet temperature detecting function, a fabricating method and a driving method thereof.

Figure 1:
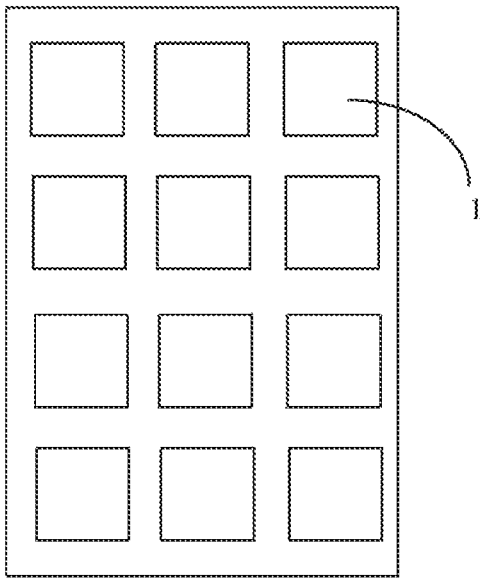
FIG. 1 is a schematic diagram of a micro-fluidic chip according to the present disclosure.
Figure 2:
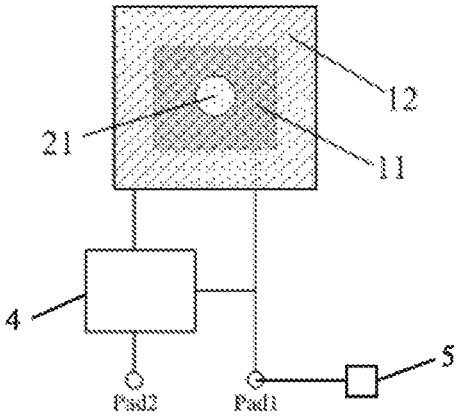
FIG. 2 is a top view of a driving circuit in a micro-fluidic chip according to an embodiment of the disclosure.
Figure 3:
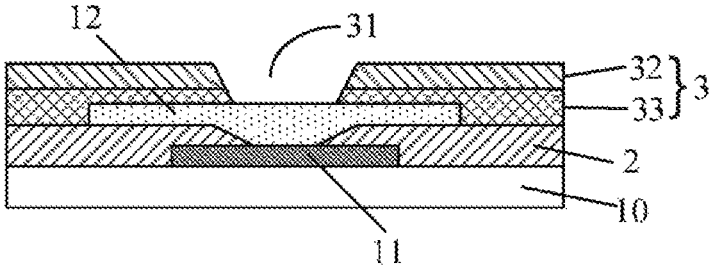
FIG. 3 is a cross-sectional view of a driving circuit in a micro-fluidic chip according to an embodiment of the disclosure.

As shown in FIGS. 1 to 3, the embodiment provides a digital micro-fluidic chip, which includes a substrate 10, and a plurality of driving circuits 1 and a voltage supply sub-circuit 5 (e.g., a power supply) on the substrate 10, each of the driving circuits 1 including a driving electrode and a detecting sub-circuit. Each driving electrode includes a first electrode plate 11 and a second electrode plate 12 which are sequentially arranged on the substrate 10 and made of different materials. The first electrode plate 11 and the second electrode plate 12 are electrically coupled to each other. The detecting sub-circuit includes a first signal terminal Pad 1 and a second signal terminal Pad 2. The first signal terminal Pad 1 is electrically coupled to the first electrode plate 11. The second signal terminal Pad 2 is electrically coupled to the second electrode plate 12. The voltage supply sub-circuit is configured to supply a driving voltage to the first signal terminal Pad 1 to control a movement of a droplet during a droplet driving stage; and to supply a constant voltage to the first signal terminal Pad 1 during a temperature detecting stage. Subsequently, the detecting sub-circuit measures a voltage difference between the first signal terminal Pad 1 and the second signal terminal Pad 2, and obtains a temperature of the droplet on the second electrode plate 12 according to the voltage difference between the first signal terminal Pad 1 and the second signal terminal Pad 2.

It will be understood that, during the droplet driving stage, the voltage supply sub-circuit 5 applies the driving voltage to one of the driving circuits through the first signal terminal, so that the droplet on another driving circuit to which the driving voltage is not applied can move toward the driving circuit to which the driving voltage is applied, thereby driving the droplet to move as desired.

It should be noted that an insulating layer 3 may be further provided on the second electrode plate 12, and a second via hole 31 is provided at a position of the insulating layer corresponding to a position where the first electrode plate 11 is couple to the second electrode plate 12 of the driving electrode, so that a part of the droplet is in contact with the second electrode plate.

The micro-fluidic chip of the present embodiment can apply the driving voltage to the first electrode plate 11 coupled to the first signal terminal Pad 1 through the voltage supply sub-circuit to complete the driving of the droplet during the droplet driving stage. In addition, since the first electrode plate 11 and the second electrode plate 12 of the driving electrode are made of different materials and are electrically coupled to each other, they constitute a thermocouple structure. Thus, during the temperature detecting stage, since there is a temperature difference between the position (corresponding to the hot end of the thermocouple) where the droplet exists and the first electrode plate 11 is coupled to the second electrode plate 12 and the positions of the first electrode plate 11 and the second electrode plate 12 (corresponding to the cold ends of the thermocouple) where the first signal terminal Pad 1 is electrically coupled to the first electrode plate 11 and the second signal terminal Pad 2 is electrically coupled to the second electrode plate 12, a thermoelectromotive force (i.e., a voltage difference) is generated between the first signal terminal Pad 1 and the second signal terminal Pad 2 due to the Seebeck effect. According to the function relation between the thermoelectromotive force and the temperature, a thermocouple reference table can be made.

Thus, referring to the thermocouple reference table, the temperature of the droplet on the second electrode plate 12 can be obtained according to the voltage difference between the first signal terminal Pad 1 and the second signal terminal Pad 2. That is to say, the digital micro-fluidic chip in the embodiment can not only drive the droplet, but also detect the temperature of the droplet, thereby improving the integration of the digital micro-fluidic chip.

In the present embodiment, optionally, the first electrode plate 11 and the second electrode plate 12 of each driving electrode are sequentially disposed in a direction away from the substrate 10, and an orthographic projection of the first electrode plate 11 on the substrate 10 at least partially overlaps with that of the second electrode plate 12 on the substrate 10. An interlayer insulating layer 2 is provided between the first electrode plate 11 and the second electrode plate 12. The first electrode plate 11 is coupled to the second electrode plate 12 through a first via hole 21 penetrating through the interlayer insulating layer 2. In order to facilitate the connection between the first electrode plate 11 and the second electrode plate 12, the first via hole 21 is located at a position where the first electrode plate 11 overlaps with the second electrode plate 12. According to an embodiment of the present disclosure, the orthographic projection of the first electrode plate 11 on the substrate 10 completely overlaps with that of the second electrode plate 12 on the substrate 10, so that as many driving electrodes as possible can be fabricated on the substrate 10 per unit area, thereby enabling more precise control of the droplet.

Alternatively, according to the embodiment of the present disclosure, the first electrode plate 11 and the second electrode plate 12 of each driving electrode may be arranged side by side as long as they are made of different materials and are electrically coupled to each other. However, in the present embodiment, the case that the first electrode plate 11 is in a different layer from the second electrode plate 12 in each driving electrode is taken as an example.

In the driving electrode of this embodiment, the first electrode plate 11 is made of molybdenum (Mo), and the second electrode plate 12 is made of Indium Tin Oxide (ITO). The two conductors of different materials are electrically coupled to each other by the first via hole 21 penetrating through the interlayer insulating layer 2. The overlap of the two conductors (i.e., the position of the second electrode plate 12 corresponding to the first via hole 21) serves as a portion in direct contact with the droplet, i.e., a temperature measurement point.

According to an embodiment of the present disclosure, the insulating layer 3 located on the second electrode plate 12 of the driving electrode includes a first insulating layer 32 and a second insulating layer 33. The second via hole 31 is formed in the first insulating layer 32 and the second insulating layer 33. At least a part of the second electrode plate 12 is exposed at the second via hole 31. The material of the second insulating layer 33 includes a hydrophobic material. For example, the hydrophobic material includes teflon, and other hydrophobic materials having insulating properties may be used, which will not listed herein. Since the second insulating layer 33 is made of the hydrophobic material, it has a repulsive force to the liquid, so that a part of the droplet may easily move into the second via hole 31. According to an embodiment of the present disclosure, the first insulating layer 32 is made of a hydrophilic material, so that a part of the sidewall of the second via hole 31 included in the first insulating layer has an attraction force to the droplet, and a part of the droplet can be well accommodated in the second via hole 31.

The detecting sub-circuit in the digital micro-fluidic chip of the embodiment includes not only the first signal terminal Pad 1 and the second signal terminal Pad 2, but also a first resistor R1 and a multistage amplifier circuit 4 having amplifier stages. A first end of the first resistor R1 is coupled to the second electrode plate 12, a second end of the first resistor R1 is coupled to a non-inverting input terminal of a first amplifier stage of the multistage amplifier circuit, an output terminal of a last amplifier stage of the multistage amplifier circuit is coupled to the second signal terminal Pad 2, and inverting input terminals of the amplifier stages of the multistage amplifier circuit are coupled to the first signal terminal Pad 1.

The reason for providing the multistage amplifier circuit is as follows. The first electrode plate 11 and the second electrode plate 12 of each driving circuit 1 constitute a thermocouple structure due to the electrical coupling and the difference in material therebetween. Based on the thermocouple principle, the first electrode plate 11 and the second electrode plate 12 usually have a thermoelectromotive force of only +μV/° C. For temperature change of 1° C. or less in droplet temperature, the generated thermoelectromotive force needs to be amplified by several hundred times or several thousand times, so that a considerable level of temperature detection can be obtained. The amplification factor and the stage number of the multistage amplifier circuit may be specifically set according to the specific condition of the digital micro-fluidic chip.

The following provides a specific structure of the detecting sub-circuit. Each of the amplifier stages includes: a second resistor, a third resistor, and a switch transistor. A first end of the second resistor is coupled to a control electrode of the switch transistor and is used as a non-inverting input terminal of the amplifier stage, and a second end of the second resistor and a first end of the third resistor are coupled to a power supply Vcc, a second end of the third resistor is coupled to a first electrode of the switch transistor and is used as an output terminal of the amplifier stage, a second electrode of the switch transistor is used as an inverting input terminal of the amplifier stage.

Figure 4:
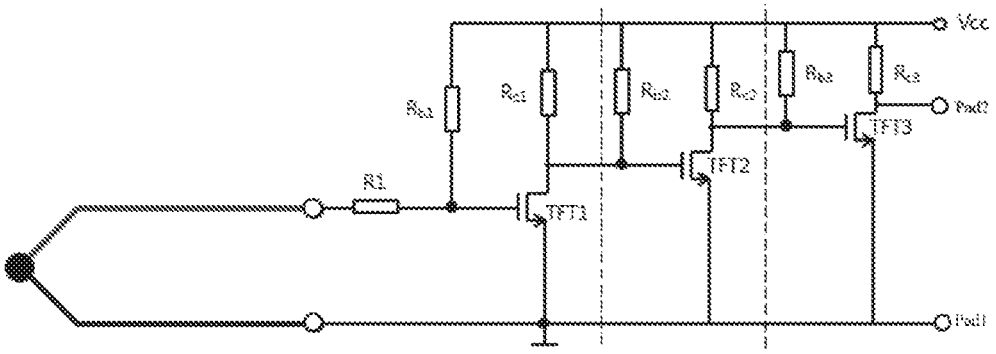
FIG. 4 is a circuit diagram of a multistage amplifier circuit in a micro-fluidic chip according to an embodiment of the present disclosure.

Specifically, as shown in FIG. 4, the detecting sub-circuit may include a directly-coupled amplifier circuit having three amplifier stages. The first amplifier stage includes a second resistor $R_{b1}$, a third resistor $R_{c1}$ and a switch transistor TFT1. A second amplifier stage includes a second resistor $R_{b2}$, a third resistor $R_{c2}$ and a switch transistor TFT2. The third amplifier stage includes a second resistor $R_{b3}$, a third resistor $R_{c3}$, and a switch transistor TFT3. A second electrode of each switch transistor is coupled to the first signal terminal Pad 1, and the first signal terminal Pad 1 is supplied with a constant voltage during the temperature detecting stage, so the first signal terminal Pad 1 may be grounded, thereby facilitating calculation for obtaining the voltage difference between the first signal terminal Pad 1 and the second signal terminal Pad 2. In addition, the directly-coupled amplifier circuit in the embodiment has good low-frequency characteristics, and can amplify signals with slow changes. Of course, the multistage amplifier circuit is not limited to the above-described structure, and other elements having a signal amplification function, such as an operational amplifier, may be used, which will not be listed one by one herein.

Figure 5:
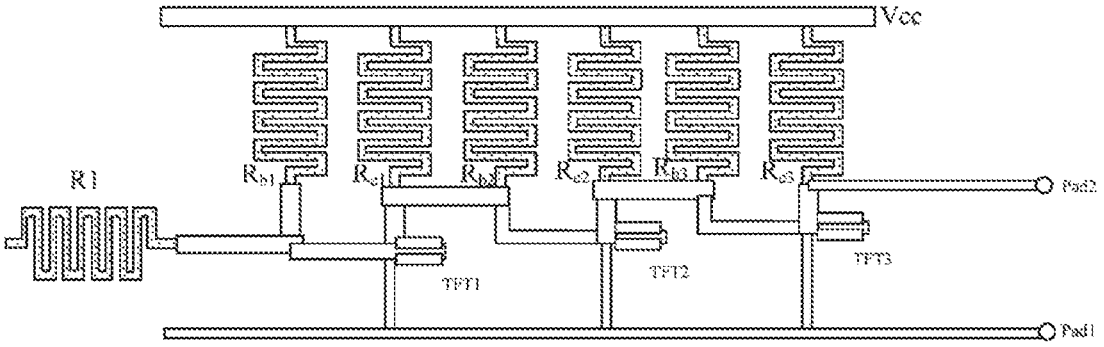
FIG. 5 is a schematic structural diagram of a multistage amplifier circuit in a micro-fluidic chip according to an embodiment of the present disclosure.

As shown in FIG. 5, the first resistor R1, the second resistor, and the third resistor described above all may be resistance wires, and the resistance wires and the second electrode plate 12 are arranged in the same layer and made of the same material. That is, when the second electrode plate 12 is made of ITO, the resistance wire is formed by ITO winding. Therefore, the process steps for fabricating the resistance wires may not be increased, and the fabricating process of the micro-fluidic chip is optimized.

Correspondingly, the embodiment also provides a driving method of the above digital micro-fluidic chip, which includes a droplet driving stage and a temperature detecting stage. During the droplet driving stage, the driving voltage is applied to the first signal terminal Pad 1 by the voltage supply sub-circuit, and the driving voltage is transferred to the first electrode plate 11 through the first signal terminal Pad 1, so that the droplet moves to the driving circuit including the first electrode plate 11. During the temperature detecting stage, since the first electrode plate 11 and the second electrode plate 12 are made of different materials and are electrically coupled to each other, they constitute a thermocouple structure. Thus, during the temperature detecting stage, since there is a temperature difference between the position (corresponding to the hot end of the thermocouple) where the droplet exists and the first electrode plate 11 is coupled to the second electrode plate 12 and the positions of the first electrode plate 11 and the second electrode plate 12 (corresponding to the cold ends of the thermocouple) where the first signal terminal Pad 1 is electrically coupled to the first electrode plate 11 and the second signal terminal Pad 2 is electrically coupled to the second electrode plate 12, the thermoelectromotive force is generated between the first signal terminal Pad 1 and the second signal terminal Pad 2 due to the Seebeck effect. According to the function relation between the thermoelectromotive force and the temperature, a thermocouple reference table can be made.

Thus, referring to the thermocouple reference table, the temperature of the droplet on the second electrode plate 12 can be obtained according to the voltage difference between the first signal terminal Pad 1 and the second signal terminal Pad 2.

In conclusion, the digital micro-fluidic chip in the embodiment can not only drive the droplet, but also detect the temperature of the droplet, thereby improving the integration of the digital micro-fluidic chip.

Figure 6:
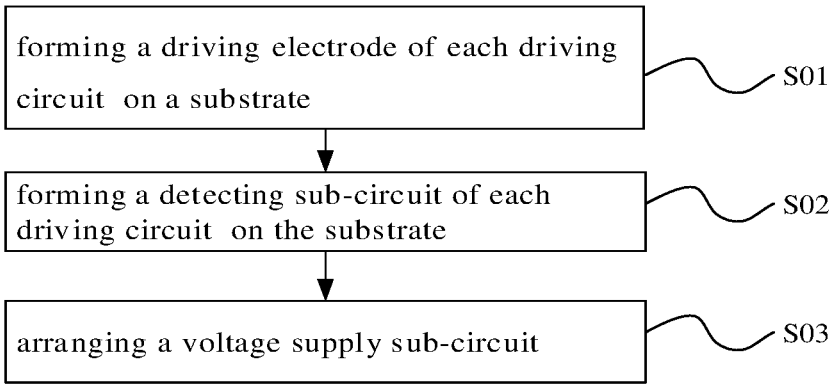
FIG. 6 is a flowchart illustrating a method of fabricating a micro-fluidic chip.

The present embodiment provides a fabricating method of a micro-fluidic chip, which may be the digital micro-fluidic chip in the above embodiments. Referring to FIG. 6, the fabricating method includes steps S01 to S03.

Step S01 includes forming a driving electrode of each driving circuit 1 on a substrate 10. Specifically, a first electrode plate 11 and a second electrode plate 12 of the driving electrode are formed on the substrate 10, respectively. Step S02 includes forming a detecting sub-circuit of each driving circuit 1 on the substrate 10. Forming the detecting sub-circuit includes forming a first signal terminal Pad 1 and a second signal terminal Pad 2, the first signal terminal Pad 1 being electrically coupled to the first electrode plate 11, and the second signal terminal Pad 2 being electrically coupled to the second electrode plate 12. Step S03 includes arranging a voltage supply sub-circuit for applying corresponding voltages to the first signal terminal Pad 1 during the droplet driving stage and the temperature detecting stage, respectively.

In the embodiment, optionally, the first electrode plate 11 and the second electrode plate 12 of each driving electrode are sequentially disposed in the direction away from the substrate 10, and an orthographic projection of the first electrode plate 11 on the substrate 10 at least partially overlaps with that of the second electrode plate 12 on the substrate 10. An interlayer insulating layer 2 is provided between the first electrode plate 11 and the second electrode plate 12. The first electrode plate 11 is coupled to the second electrode plate 12 through a first via hole 21 penetrating through the interlayer insulating layer 2. In order to facilitate connection between the first electrode plate 11 and the second electrode plate 12, the first via hole 21 is located at a position where the first electrode plate 11 overlaps with the second electrode plate 12. According to an embodiment of the present disclosure, the orthographic projection of the first electrode plate 11 on the substrate 10 completely overlaps with that of the second electrode plate 12 on the substrate 10, so that as many driving electrodes as possible can be fabricated on the substrate 10 per unit area, thereby enabling more precise control of the droplet.

Of course, the first electrode plate 11 and the second electrode plate 12 of each driving electrode in the embodiment may be arranged side by side as long as they are made of different materials and are electrically coupled to each other. However, in the present embodiment, the case that the first electrode plate 11 is in a different layer from the second electrode plate 12 in each driving electrode is taken as an example.

Figure 7:
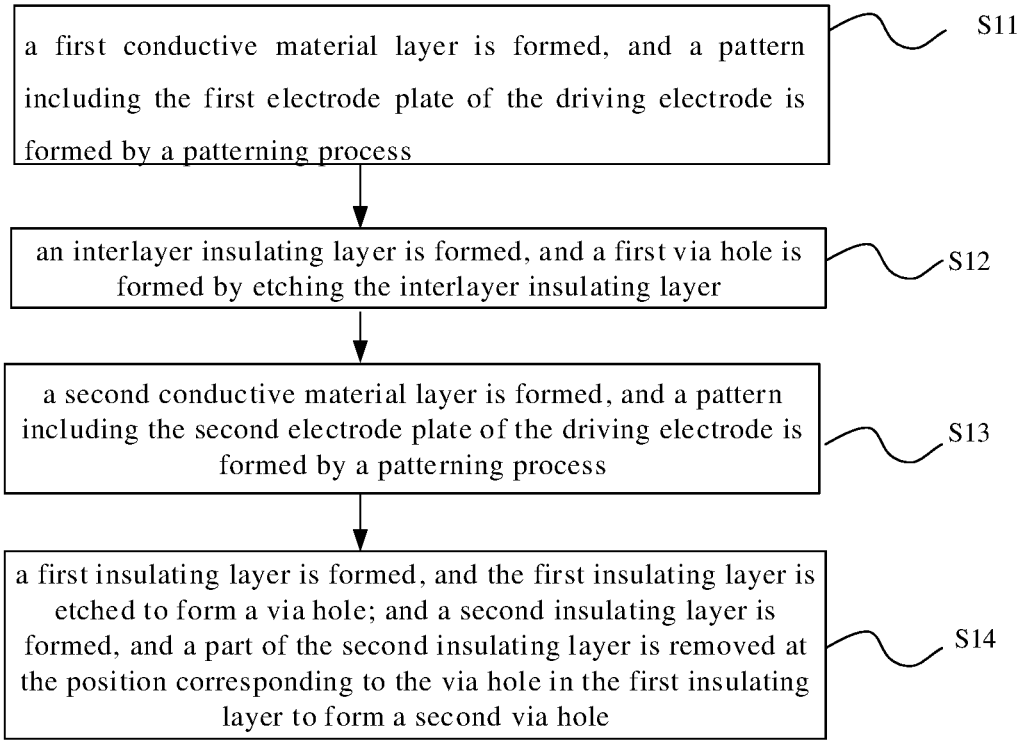
FIG. 7 is a flowchart illustrating a method of fabricating each driving electrode of the micro-fluidic chip.

FIG. 7 is a flowchart illustrating a fabricating method of each driving electrode of the micro-fluidic chip.

The fabricating method of each driving electrode of the micro-fluidic chip in the present embodiment will be described in detail below with reference to FIG. 7.

In step S11, a first conductive material layer is formed on the substrate 10, and a pattern including the first electrode plate 11 of the driving electrode is formed by a patterning process. The first conductive material layer is made of a metal material such as molybdenum.

In step S12, an interlayer insulating layer 2 is formed on the substrate 10 subjected to the previous step, and a first via hole 21 is formed by etching the interlayer insulating layer 2. The material of the interlayer insulating layer 2 includes an insulating material such as silicon nitride.

In step S13, a second conductive material layer is formed on the substrate 10 subjected to the previous step, and a pattern including the second electrode plate 12 of the driving electrode is formed by a patterning process. The second electrode plate 12 is electrically coupled to the first electrode plate 11 through the first via hole 21.

In step S14, a first insulating layer is formed on the substrate 10 subjected to the previous step, and the first insulating layer is etched to form a via hole; and a second insulating layer is formed, and a part of the second insulating layer is removed at the position corresponding to the via hole in the first insulating layer to form a second via hole 31. Alternatively, the second via hole 31 penetrating through the first insulating layer and the second insulating layer may be formed after the first insulating layer and the second insulating layer are formed. At least a part of the second electrode plate 12 is exposed at the second via hole 31, such that when a portion of the droplet is above the second electrode plate 12, it can directly contact the second electrode plate 12 at the second via hole 31, thereby forming a measurement point for sensing the temperature of the droplet. The material of the first insulating layer includes an insulating material such as silicon nitride. The material of the second insulating layer includes a hydrophobic material. For example, the hydrophobic material includes teflon, but it is also possible to use other hydrophobic material having insulating property, which will not be listed here. Since the second insulating layer is made of the hydrophobic material, it has a repulsive force to the liquid, so that a part of the droplet may easily move into the second via hole 31. According to an embodiment of the present disclosure, the first insulating layer is made of a hydrophilic material, so that a part of the side wall of the second via hole 31 included in the first insulating layer has an attraction force to the droplet, which allows a part of the droplet to be well accommodated in the second via hole 31.

The detecting sub-circuit in the embodiment includes not only the first signal terminal Pad 1 and the second signal terminal Pad 2, but also a first resistor R1 and a multistage amplifier circuit 4 having amplifier stages. Each of the amplifier stages includes: a second resistor, a third resistor, and a switch transistor. A first end of the second resistor is coupled to a control electrode of the switch transistor and is used as a non-inverting input terminal of the amplifier stage, a second end of the second resistor and a first end of the third resistor are coupled to a power supply Vcc, a second end of the third resistor is coupled to a first electrode of the switch transistor and is used as an output terminal of the amplifier stage, and a second electrode of the switch transistor is used as an inverting input terminal of the amplifier stage.

Specifically, as shown in FIG. 4, the detecting sub-circuit may include a directly-coupled amplifier circuit having three amplifier stages. The first amplifier stage includes a second resistor $R_{b1}$, a third resistor $R_{c1}$ and a switch transistor TFT1. A second amplifier stage includes a second resistor $R_{b2}$, a third resistor $R_{c2}$ and a switch transistor TFT2. The third amplifier stage includes a second resistor $R_{b3}$, a third resistor $R_{c3}$, and a switch transistor TFT3. A second electrode of each switch transistor is coupled to the first signal terminal Pad 1, and the first signal terminal Pad 1 is supplied with a constant voltage during the temperature detecting stage, so the first signal terminal Pad 1 may be grounded, thereby facilitating calculation for obtaining the voltage difference between the first signal terminal Pad 1 and the second signal terminal Pad 2. In addition, the directly-coupled amplifier circuit in the embodiment has good low-frequency characteristics, and can amplify signals with slow changes.

The first resistor R1, the second resistor, and the third resistor described above all may be resistance wires, and the resistance wires and the second electrode plate 12 are arranged in the same layer and made of the same material. That is, when the second electrode plate 12 is made of ITO, the resistance wire is formed by ITO winding. Therefore, the process steps for fabricating the resistance wires may not be increased, and the fabricating process of the micro-fluidic chip is optimized.

The switch transistor in the embodiment may include structures of a gate electrode, a source electrode, and a drain electrode formed by using the conventional process, which will not be described in detail herein.

The micro-fluidic chip formed by the fabricating method of the present embodiment can apply a driving voltage to the first electrode plate 11 coupled to the first signal terminal Pad 1 through the voltage supply sub-circuit to complete the driving of the droplet during the droplet driving stage. In addition, since the first electrode plate 11 and the second electrode plate 12 in the driving electrode are made of different materials and are electrically coupled, they constitute a thermocouple structure. Thus, during the temperature detecting stage, since there is a temperature difference between the position (corresponding to the hot end of the thermocouple) where the droplet exists and the first electrode plate 11 is coupled to the second electrode plate 12 and the positions of the first electrode plate 11 and the second electrode plate 12 (corresponding to the cold ends of the thermocouple) where the first signal terminal Pad 1 is electrically coupled to the first electrode plate 11 and the second signal terminal Pad 2 is electrically coupled to the second electrode plate 12, the thermoelectromotive force is generated between the first signal terminal Pad 1 and the second signal terminal Pad 2 due to the Seebeck effect. According to the function relation between the thermoelectromotive force and the temperature, a thermocouple reference table can be made.

Thus, referring to the thermocouple reference table, the temperature of the droplet on the second electrode plate 12 can be obtained according to the voltage difference between the first signal terminal Pad 1 and the second signal terminal Pad 2.

That is to say, the digital micro-fluidic chip in the embodiment can not only drive the droplet, but also detect the temperature of the droplet, thereby improving the integration of the digital micro-fluidic chip.

It is to be understood that the above embodiments are merely exemplary embodiments to explain the principles of the present disclosure, and the present disclosure is not limited thereto. Various modifications and improvements may be made by those skilled in the art without departing from the spirit and scope of the disclosure, and are also considered to be within the scope of the disclosure.

The invention claimed is:

1. A micro-fluidic chip comprising: a substrate and a plurality of driving circuits on the substrate, each of the plurality of driving circuits comprising:

a driving electrode comprising a first electrode plate and a second electrode plate made of different materials on the substrate, the first electrode plate being electrically coupled to the second electrode plate; and a detecting sub-circuit comprising a first signal terminal electrically coupled to the first electrode plate and a second signal terminal electrically coupled to the second electrode plate, wherein the micro-fluidic chip further comprises: a voltage supply sub-circuit configured to supply a driving voltage to the first signal terminal to control a droplet to move toward the driving circuit during a droplet driving stage, and configured to supply a constant voltage to the first signal terminal, during a temperature detecting stage, and wherein the detecting sub-circuit is configured to measure a voltage difference between the first signal terminal and the second signal terminal, and obtain a temperature of a droplet on the second electrode plate according to the voltage difference, during the temperature detecting stage, wherein the detecting sub-circuit further comprises: a first resistor and a multistage amplifier circuit having amplifier stages, and a first end of the resistor is coupled to the second electrode plate, a second end of the first resistor is coupled to a non-inverting input terminal of a first amplifier stage of the multistage amplifier circuit, an output terminal of a last amplifier stage of the multistage amplifier circuit is coupled to the second signal terminal, and inverting input terminals of the amplifier stages of the multistage amplifier circuit are coupled to the first signal terminal.

2. The micro-fluidic chip of claim 1, wherein the voltage supply sub-circuit is configured to apply a ground voltage to the first signal terminal during the temperature detecting stage.

3. The micro-fluidic chip of claim 1, wherein each of the amplifier stages of the multistage amplifier circuit comprises a second resistor, a third resistor, and a switch transistor, and a first end of the second resistor is coupled to a control electrode of the switch transistor and is used as a non-inverting input terminal of the amplifier stage, and a second end of the second resistor and a first end of the third resistor are coupled to a power supply, a second end of the third resistor is coupled to a first electrode of the switch transistor and is used as an output terminal of the amplifier stage, and a second electrode of the switch transistor is used as an inverting input terminal of the amplifier stage.

4. The micro-fluidic chip of claim 3, wherein the first resistor, the second resistor, and the third resistor each comprise a resistance wire, and the resistance wire and the second electrode plate are arranged on a same layer and made of a same material.

5. The micro-fluidic chip of claim 1, wherein the first electrode plate and the second electrode plate of the driving electrode are sequentially arranged along a direction away from the substrate, an orthographic projection of the first electrode plate at least partially overlaps with that of the second electrode plate on the substrate, and the first electrode plate and the second electrode plate are electrically coupled to each other through a first via hole penetrating through an interlayer insulating layer between the first electrode plate and the second electrode plate.

6. The micro-fluidic chip of claim 1, wherein a first insulating layer is further disposed on a side of the driving electrode away from the substrate, and a second via hole is formed in the first insulating layer and exposes at least a part of the second electrode plate.

7. The micro-fluidic chip of claim 6, wherein a second insulating layer is further disposed on a side of the first insulating layer away from the substrate, the second via hole penetrates through the second insulating layer to expose at least a part of the second electrode plate, and a material of the second insulating layer comprises a hydrophobic material.

8. The micro-fluidic chip of claim 7, wherein the first insulating layer comprises a hydrophilic material.

9. The micro-fluidic chip of claim 1, wherein a material of the first electrode plate comprises molybdenum, and a material of the second electrode plate comprises indium tin oxide; or the material of the first electrode plate comprises indium tin oxide, and the material of the second electrode plate comprises molybdenum.

10. A fabricating method of a micro-fluidic chip, comprising:

forming a driving electrode of each driving circuit on a substrate, wherein forming the driving electrode comprises: respectively forming a first electrode plate and a second electrode plate of the driving electrode on the substrate, the first electrode plate and the second electrode plate being made of different materials, the first electrode plate being electrically coupled to the second electrode plate;

forming a detecting sub-circuit of each driving circuit on the substrate, wherein forming the detecting sub-circuit comprises forming a first signal terminal and a second signal terminal, the first signal terminal being electrically coupled to the first electrode plate, and the second signal terminal being electrically coupled to the second electrode plate; and arranging a voltage supply sub-circuit configured to apply corresponding voltages to the first signal terminal during a droplet driving stage and a temperature detecting stage, respectively, wherein the detecting sub-circuit is configured to measure a voltage difference between the first signal terminal and the second signal terminal, and obtain a temperature of a droplet on the second electrode plate according to the voltage difference during the temperature detecting stage, wherein the detecting sub-circuit further comprises: a first resistor and a multistage amplifier circuit having amplifier stages, each amplifier stage of the multistage amplifier circuit comprises a second resistor, a third resistor and a switch transistor, and the first resistor, the second resistor and the third resistor each comprises a resistance wire; and the resistance wire and the second electrode plate are formed by one patterning process.

11. The fabricating method of claim 10, wherein respectively forming the first electrode plate and the second electrode plate of the driving electrode on the substrate comprises:

forming the first electrode plate on the substrate;

forming an interlayer insulating layer, and etching the interlayer insulating layer to form a first via hole; and forming the second electrode plate, the first electrode plate and the second electrode plate being electrically coupled to each other through the first via hole, and an orthographic projection of the first electrode plate on the substrate at least partially overlapping with an orthographic projection of the second electrode plate on the substrate.

12. The fabricating method of claim 10, further comprising, after forming the second electrode plate, forming a first insulating layer, and etching the first insulating layer to form a via hole; and forming a second insulating layer, and removing a material of the second insulating layer at a position corresponding to the via hole in the first insulating layer to form a second via hole penetrating through the first insulating layer and the second insulating layer; wherein at least a part of the second electrode plate is exposed at the second via hole, and a material of the second insulating layer comprises a hydrophobic material.

13. The fabricating method of claim 10, further comprising, after forming the second electrode plate, forming a first insulating layer;

forming a second insulating layer; and etching the first insulating layer and the second insulating layer to form a second via hole penetrating through the first insulating layer and the second insulating layer; wherein at least a part of the second electrode plate is exposed at the second via hole, a material of the second insulating layer comprises a hydrophobic material, and a material of the first insulating layer comprises a hydrophilic material.

14. A driving method of a micro-fluidic chip, wherein the micro-fluidic chip is the micro-fluidic chip of claim 1, and the method comprises:

during a droplet driving stage, applying, by the voltage supply sub-circuit, the driving voltage to the first signal terminal to control a droplet to move toward the driving circuit; and during a temperature detecting stage, applying a low power supply voltage to the first signal terminal by the voltage supply sub-circuit, and measuring the voltage difference between the first signal terminal and the second signal terminal and obtaining a temperature of the droplet on the second electrode plate according to the voltage difference, by the detecting sub-circuit.

15. The micro-fluidic chip of claim 2, wherein a first insulating layer is further disposed on a side of the driving electrode away from the substrate, and a second via hole is formed in the first insulating layer and exposes at least a part of the second electrode plate.

16. The micro-fluidic chip of claim 3, wherein a first insulating layer is further disposed on a side of the driving electrode away from the substrate, and a second via hole is formed in the first insulating layer and exposes at least a part of the second electrode plate.

* * * * *